US008739353B2

(12) United States Patent
Pisacane et al.

(10) Patent No.: US 8,739,353 B2
(45) Date of Patent: Jun. 3, 2014

(54) SPONGE WITH MOCROFIBER

(75) Inventors: Fred Pisacane, San Diego, CA (US); Shannon Milican, Spring Valley, CA (US)

(73) Assignee: Foamtec International Co., Ltd., Oceanside, CA (US)

( * ) Notice: Subject to any disclaimer, the term of this patent is extended or adjusted under 35 U.S.C. 154(b) by 396 days.

(21) Appl. No.: 13/081,176

(22) Filed: Apr. 6, 2011

(65) Prior Publication Data

US 2011/0239394 A1 Oct. 6, 2011

Related U.S. Application Data

(60) Provisional application No. 61/321,421, filed on Apr. 6, 2010.

(51) Int. Cl.
*A47L 13/16* (2006.01)

(52) U.S. Cl.
USPC ..... 15/244.4; 15/118

(58) Field of Classification Search
USPC ..... 15/244.1–244.4, 208–210.1, 118; D32/40
See application file for complete search history.

(56) References Cited

U.S. PATENT DOCUMENTS

| | | | | |
|---|---|---|---|---|
| 2,121,384 | A * | 6/1938 | Gray | 15/105 |
| 3,656,202 | A * | 4/1972 | Paton | 15/121 |
| 3,889,938 | A | 6/1975 | Brand | |
| 6,418,587 | B1 * | 7/2002 | Kent et al. | 15/322 |
| 7,621,802 | B2 * | 11/2009 | McCarthy | 451/523 |
| 2005/0273958 | A1 * | 12/2005 | Dillon | 15/104.93 |
| 2009/0094772 | A1 * | 4/2009 | Lee et al. | 15/244.3 |
| 2009/0276971 | A1 | 11/2009 | Nozari | |

FOREIGN PATENT DOCUMENTS

| | | | | |
|---|---|---|---|---|
| FR | 2 541 886 | A1 | 9/1984 | |
| WO | 95/31923 | A1 | 11/1995 | |
| WO | WO 97/49326 | * | 12/1997 | A47L 13/16 |

* cited by examiner

*Primary Examiner* — Laura C Guidotti
(74) *Attorney, Agent, or Firm* — Zeman-Mullen & Ford, LLP

(57) ABSTRACT

A sponge with microfiber which includes a foam sponge having a front side, a back side, and a plurality of edges between the front and back sides and a microfiber material laminated to one side of the foam sponge. The microfiber material may be inset from all edges of the foam sponge on the side of the foam sponge to which it is laminated and one or more of the plurality of edges of the foam sponge may be contoured and comprise a beveled edge and/or a chamfered edge.

9 Claims, 8 Drawing Sheets

SPONGE WITH MOCROFIBER

CROSS-REFERENCE TO RELATED APPLICATIONS

This application claims priority to provisional patent application having Ser. No. 61/321,421, filed Apr. 6, 2010, which is herein incorporated by reference in its entirety.

BACKGROUND OF THE INVENTION

Sponges with microfiber are commercially available for everyday cleaning. However, existing sponges with microfiber typically have microfiber fabric or material sewn around the entire perimeter of an absorbent sponge. In some products, an absorbent sponge is enclosed within two pieces of microfiber material sewn together with one side comprising a microfiber material having scrubbing strips attached to it (also know as the grim buster side) and the other side comprising a microfiber material without such scrubbing strips (also known as the soft side).

Currently existing microfiber sponges all have absorbent sponges that are completely contained within a microfiber fabric or microfiber material. In addition, the sponges are contained within the microfiber fabric or microfiber material by sewing one or more pieces of microfiber fabric or microfiber material around the sponges. Unfortunately, there are some drawbacks with the currently existing microfiber sponges. For example, the sewn edges of the microfiber fabric or the microfiber material around the edges of the sponge can get caught and/or snagged while cleaning and, as a result, can get torn away from the sponge that is contained by them. Sewing the edges of the microfiber fabric or the microfiber material around the perimeter of a sponge is not the strongest and most durable process for enclosing the sponge within the microfiber fabric or microfiber material. As a result, the currently existing microfiber sponges are less durable and therefore have a shorter useful lifespan than other types of cleaning products. In addition, currently existing microfiber sponges cannot be used for a number of applications, such as in tile and grout applications, where a user needs to remove a specific amount of material (e.g. grout between tiles) during the clean up process.

Accordingly, there is a need for a strong, durable sponge with microfiber that can be used for a variety of applications including those applications where it would be beneficial to have both a sponge surface and a microfiber fabric or material surface available for cleaning.

SUMMARY OF THE INVENTION

The present invention is directed to a sponge with microfiber which includes a foam sponge having front side, a back side, and a plurality of edges between the front and back sides and a microfiber material laminated to at least one side of the foam sponge. In one exemplary embodiment of the sponge with microfiber, the microfiber material is inset from all edges of the foam sponge on the side of the foam sponge to which it is laminated.

In another exemplary embodiment of the sponge with microfiber, at least one of the plurality of edges of the foam sponge is a beveled edge. In still another exemplary embodiment of the sponge with microfiber, each of the plurality of edges of the foam sponge are beveled edges. In yet another exemplary embodiment of the sponge with microfiber, at least one of the plurality of edges of the foam sponge is a chamfered edge. In still another exemplary embodiment of the sponge with microfiber, each of the plurality of edges of the foam sponge are chamfered edges.

In another embodiment of the sponge with microfiber, the sponge with microfiber includes a permeable film positioned between the foam sponge and the microfiber material which functions to connect the foam sponge to the microfiber material. In still another exemplary embodiment of the sponge with microfiber, the permeable film is made of a polyurethane.

BRIEF DESCRIPTION OF THE DRAWINGS

The subject invention will hereinafter be described in conjunction with the appended drawing figures, wherein like numerals denote like elements.

DETAILED DESCRIPTION

The sponge with microfiber of the present invention is generally directed to a foam sponge having a microfiber material laminated to one side of the foam sponge. The microfiber material can be inset from all edges of the foam sponge on the side of the foam sponge to which it is laminated. In addition, the foam sponge can be contour cut so that the edges of the sponge with microfiber are beveled or chamfered and do not contain and ninety degree angles. The microfiber sponge of the present invention can be used in many applications and is more effective and efficient than currently existing microfiber sponges for specific applications. For example, the sponge with microfiber of the present invention is particularly suited for tile and grout applications where a user needs to remove just the right amount of grout between tiles so that the grout and tile edges are joined in a seamless and smooth nature.

Figure 1:
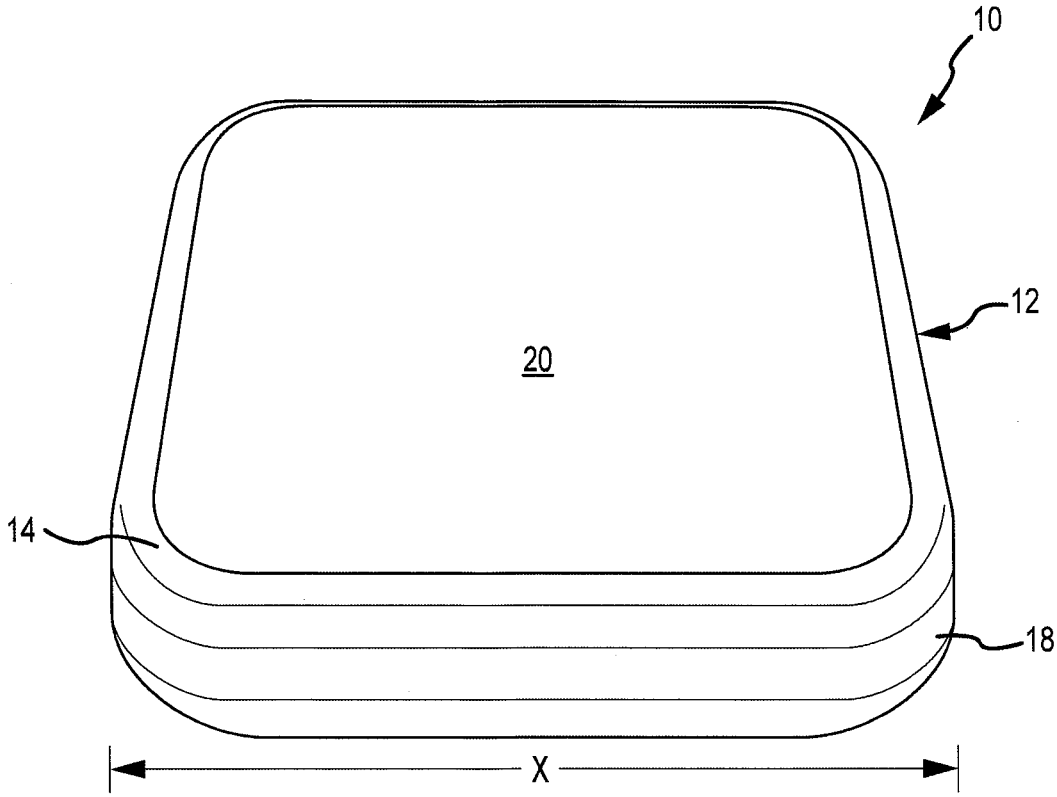
FIG. 1 is a front perspective view of an exemplary embodiment of the sponge with microfiber of the present invention showing the microfiber material containing side of the sponge shown face up with the length of the sponge in front.

FIG. 1 is a front perspective view of one exemplary embodiment of the sponge with microfiber 10 of the present invention which includes a foam sponge 12 having a front side 14, back side 16 (See FIG. 5), and a plurality of edges 18 between the front and back sides 14, 16, and a microfiber material 20 laminated to at least one side (in this case front side 14) of the foam sponge 12. The microfiber material 20 is inset from all edges 18 of the foam sponge 12 on the front side 14 of foam sponge 12. The plurality of edges 18 of the foam sponge 12 may be contoured such that the edges are beveled and/or chamfered. The sponge with microfiber 10 of the present invention may comprise many shapes, sizes, and configurations while still providing one side of a foam sponge with a micro fiber material laminated to it and edges of the foam sponge that are contoured. For example, the exemplary embodiment of the sponge with microfiber 10 of the present invention shown in FIG. 1 is rectangular in shape with a length of X where X, in one exemplary embodiment, may be 7 to 8 inches with a width Y (See FIG. 2) of 5 to 6 inches.

Figure 2:
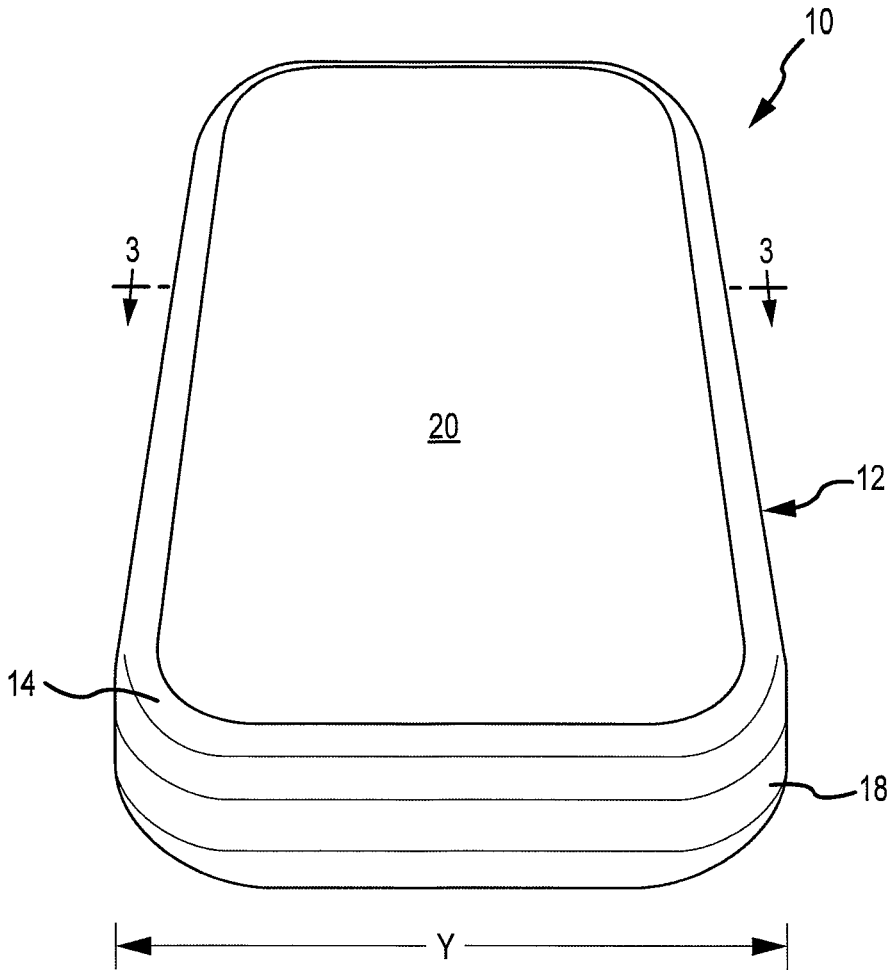
FIG. 2 is a front perspective view of the sponge with microfiber of the present invention depicted in FIG. 1 showing the microfiber material containing side of the sponge shown face up with the width of the sponge in front.

A front perspective view of the sponge with microfiber of the present invention depicted in FIG. 1 showing the micro fiber material containing side of the sponge (i.e. front side 14) shown face up with the width of the sponge in front is shown in FIG. 2. Microfiber material 20 is laminated to the front side 14 of foam sponge 12 and the plurality of edges 18 of foam sponge 12 are contoured such that they form beveled and/or chamfered edges and no ninety degree angles are present (See FIGS. 3-4). The contour cut of the foam sponge is particularly important in tile and grout applications where the tile setter does not want to remove too much grout from in between the tiles (i.e. the tile setter does not want to remove too much grout from the grout line when using a sponge to remove grout).

One purpose/application of the sponge with microfiber of the present invention is to remove excess grout so that when the grout sets or dries, the grout line does not extend above the edge of the tile. The sponge of the present invention is suited particularly well for this application. When grout extends above the edge of the tile, it makes walking on the tile hazardous. The sponge of the present invention includes micro fiber material that is inset from all edges of a foam sponge on one side of the foam sponge and the micro fiber material is laminated to the foam sponge. In addition, the foam sponge is contour cut so that the edges of the foam sponge are beveled or chamfered and do not contain any 90 degree angles. If the micro fiber on the sponge had a sewn edge, if the micro fiber material extended to the edge of the foam sponge, or if the foam sponge had any 90 degree edges, a tile setter would remove too much grout when using the sponge and the edges of the tile would be exposed. Exposing the edges of the tiles would create a hazard. The chamfered or "buffed" design of the foam sponge of the present invention with the inset layer of micro fiber material laminated to one side of the foam sponge allows a tile setter to feather the grout so that the grout and tile edge have a seamless and smooth nature.

Sponges already exist which have micro fiber fabrics or material sewn around the entire perimeter of the sponge but this type of sponge will not work in tile and grout applications like the sponge of the present invention. When used in tile and grout applications, the foam edges of the sponge with microfiber of the present invention and the opposing foam side of the sponge are used as a first pass cleaning step. The side of the sponge having the micro fiber material or fabric is then used to remove the haze layer that foam alone cannot remove.

Figure 3:
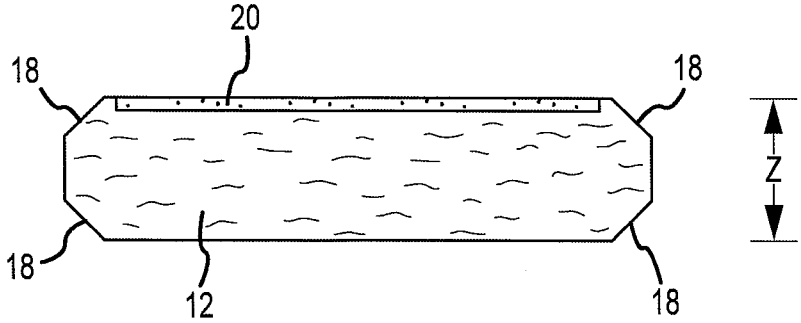
FIG. 3 is a cross-sectional view of the sponge with microfiber of the present invention taken along line 3-3 FIG. 2 showing the chamfered edges of the foam sponge.
Figure 4:
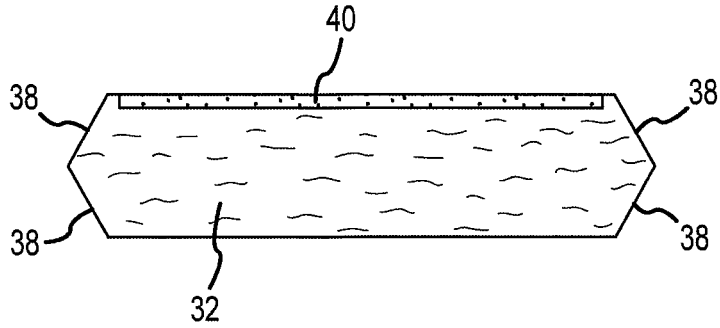
FIG. 4 is a cross-sectional view of another exemplary embodiment of the sponge with microfiber of the present invention showing the foam sponge having beveled edges.

FIG. 3 is cross-sectional view of the sponge with microfiber of the present invention taken along line 3-3 FIG. 2 showing the chamfered edges 18 of the foam sponge 12 and the microfiber material layer 20 laminated to the front side 14 of foam sponge 12. A cross-sectional view of another exemplary embodiment of the sponge with microfiber of the present invention showing the foam sponge 32 having beveled edges 38 and a microfiber material 40 laminated to a side of foam sponge 32 is shown in FIG. 4. It will be understood by those skilled in the art that the plurality of edges 18 are contoured and that such contoured edges may comprise a variety of shapes and/or configurations in addition to a beveled edge or a chamfered edge. It will also be understood by those skilled in the art that one or more of the plurality of edges 18 may be contoured and that the plurality of edges of a given foam sponge with microfiber of the present invention may take on one or more shapes and/or configurations. For example, foam sponge 12 may comprise one edge that is a beveled and one edge that is a chamfered. In another example, foam sponge 12 may comprise two opposite edges that are beveled and two opposite edges that are chamfered. In yet another example, foam sponge 12 may comprise edges that are all beveled. In still another exemplary embodiment, foam sponge 12 may comprise edges that are all chamfered. In addition, height Z of foam sponge 12 may vary and, in one exemplary embodiment, may be 2 to 3 inches when length X is 7 to 8 inches and width Y is 5 to 6 inches.

Figure 5:
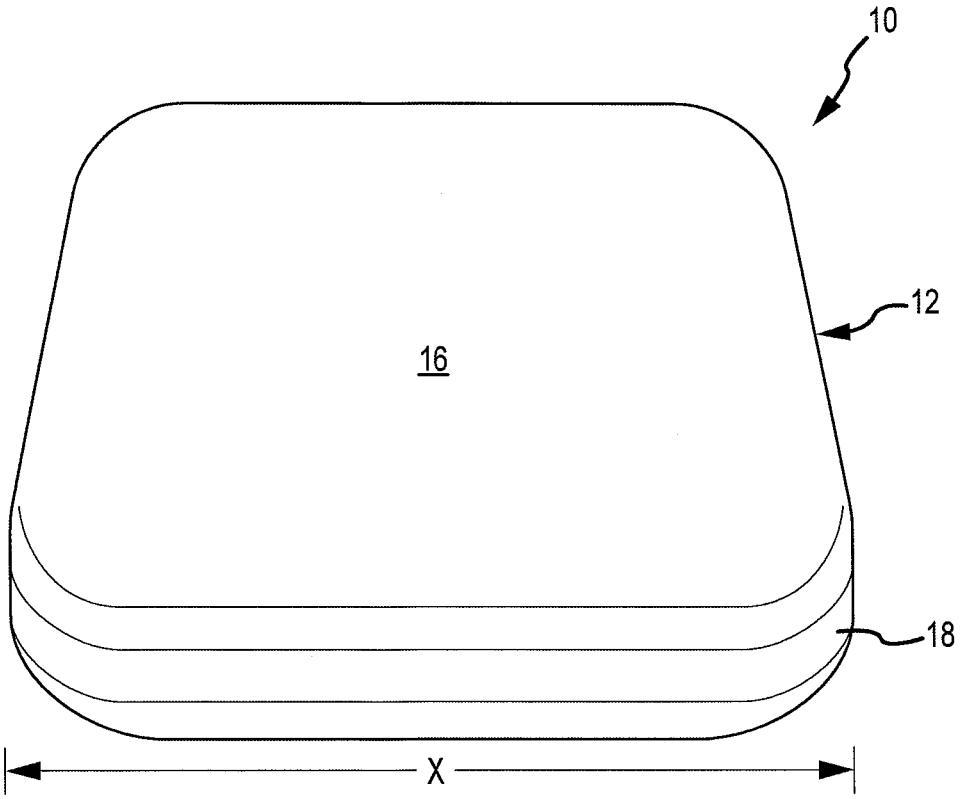
FIG. 5 is a front perspective view of the sponge with microfiber of the present invention depicted in FIG. 1 showing the non microfiber material containing side of the sponge shown face up with the length of the sponge in front.
Figure 6:
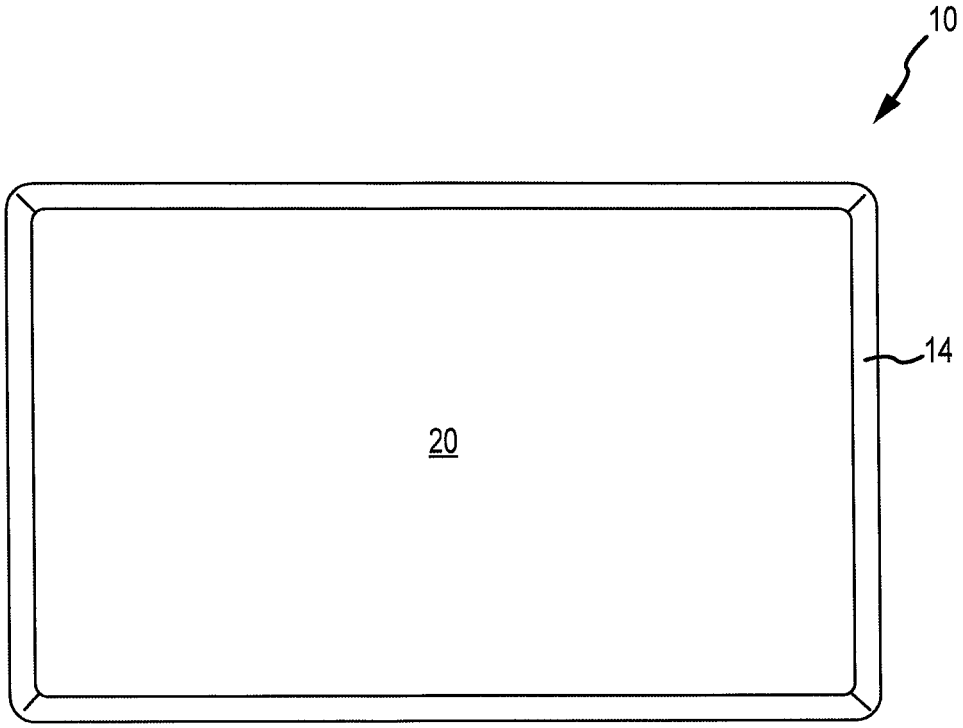
FIG. 6 is a magnified top plan view of the sponge with microfiber of the present invention depicted in FIG. 1 showing the microfiber material containing side of the sponge shown face up.

FIG. 5 is a front perspective view of the sponge with microfiber 10 of the present invention depicted in FIG. 1 showing the non microfiber material containing side of the sponge (i.e. the back side 16 of foam sponge 12) shown face up with the length X of the sponge in front. A magnified top plan view of the sponge with microfiber 10 of the present invention depicted in FIG. 1 showing the microfiber material containing side of the sponge (i.e. the front side 14 of foam sponge 12) shown face up is depicted in FIG. 6.

As previously stated, the sponge with microfiber of the present invention is particularly suited for tile and grout applications. The exposed chamfered or beveled edge(s) 18 of the foam sponge 12 acts as a soft shovel that enables the tile setter to remove just the right amount of grout. The micro fiber layer 20 on the foam sponge 12 is then used to pass over the surface that has been previously addressed with the foam sponge 12 to remove and hold the grout so that it does not spread from one point to another (i.e. from point a to point b) on the tile surface. Laminating the micro fiber material to the foam sponge allows water to permeate from the sponge to the micro fiber material or fabric so that the tile setter can easily and effectively rinse the sand (the major component of grout) from the sponge of the present invention.

Another exemplary embodiment of the sponge with microfiber of the present invention includes a permeable film positioned between the foam sponge and the microfiber material which functions to connect the foam sponge to the microfiber material. In another exemplary embodiment, the permeable film may be made of a polyurethane. It is important that the permeable film be liquid permeable so that the liquid is easily transferred from the foam sponge to the surface of the microfiber material.

Figure 7:
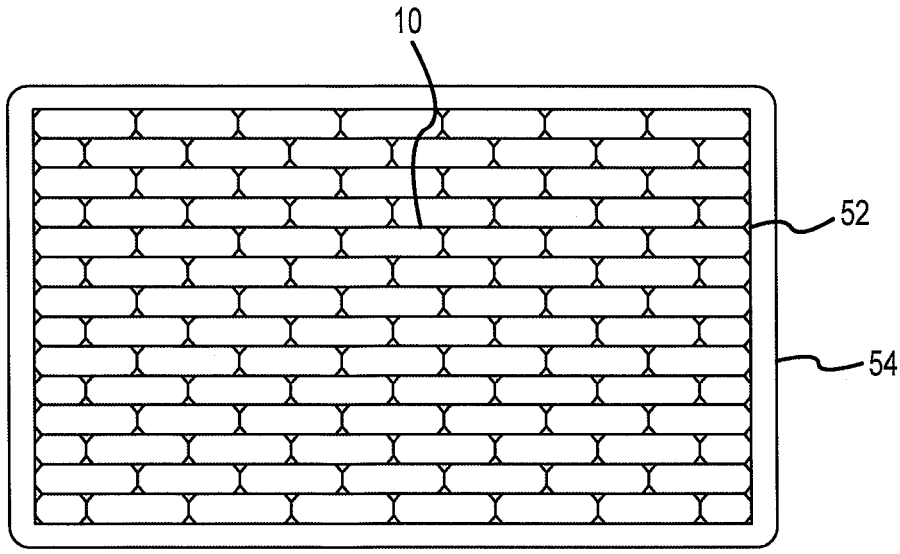
FIG. 7 shows a plurality of sponges with microfiber of the present invention packaged in accordance with the dual layer packaging described in U.S. patent application having Ser. No. 12/577,940.

A plurality of sponges with microfiber of the present invention packaged in accordance with the dual layer packaging described in U.S. patent application having Ser. No. 12/577,940, which is herein incorporated by reference in its entirety, is shown in FIG. 7. A plurality of sponges 10 of the present invention are enclosed in a first expandable material layer 52 and then compressed within the first expandable material layer 52. The compressed plurality of sponges 10 contained within the first expandable material layer 52 are then enclosed within a second non-expandable material layer 54 which retains the compressed plurality of sponges 10 and the first expandable material layer 52 in a compressed state for shipping and/or transport and/or storage.

Figure 8:
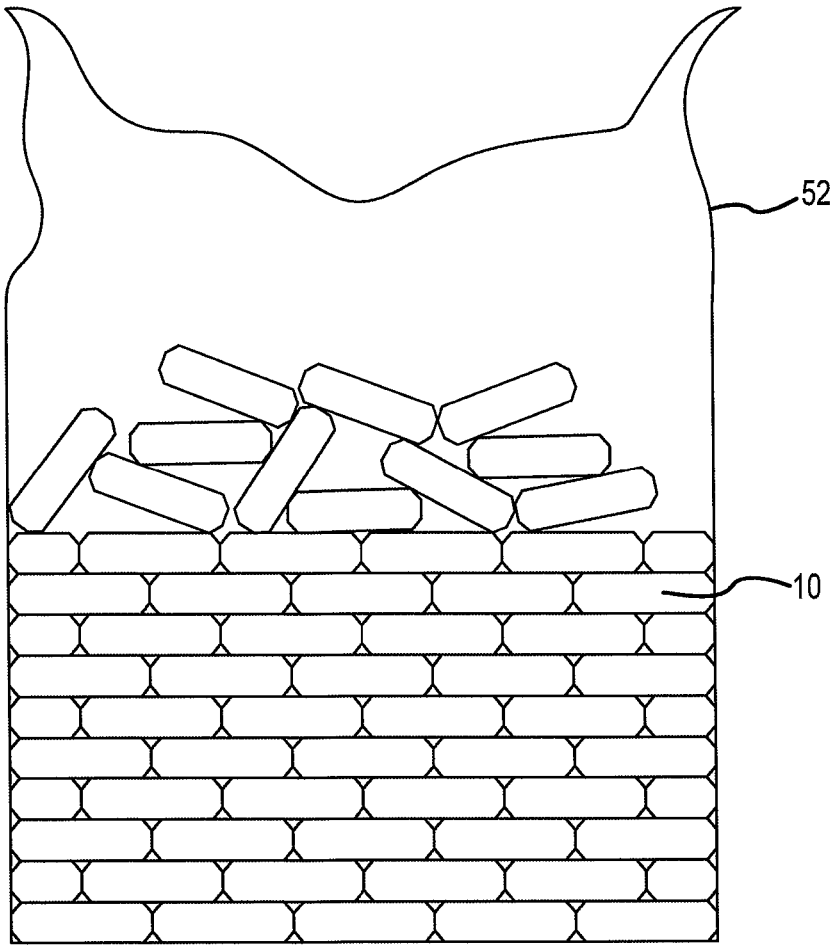
FIG. 8 shows a plurality of sponges with microfiber of the present invention packaged in accordance with the dual layer packaging described in U.S. patent application having Ser. No. 12/577,940 after the outer non-expandable layer of packaging has been removed.

FIG. 8 shows a plurality of sponges with microfiber of the present invention packaged in accordance with the dual layer packaging described in U.S. patent application having Ser. No. 12/577,940 after the outer non-expandable material layer 54 of the packaging has been removed. Once the outer non-expandable material layer 54 is removed, the compressed inner expandable material layer 52 and the compressed plurality of sponges with microfiber 10 are able to expand so that the plurality of sponges with microfiber 10 of the present invention can return to their normal non-compressed state.

Figure 9:
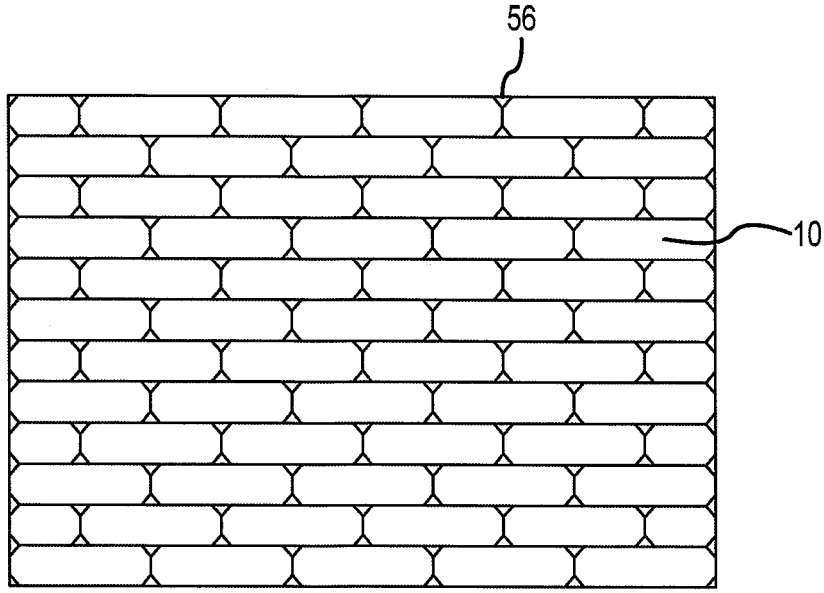
FIG. 9 shows a plurality of sponges with microfiber of the present invention packaged without the dual layer packaging described in U.S. patent application having Ser. No. 12/577,940.

A plurality of sponges with microfiber 10 of the present invention packaged without the dual layer packaging described in U.S. patent application having Ser. No. 12/577,940 are shown in FIG. 9. As can be seen in FIG. 9, the plurality of sponges with microfiber 10 are packaged within a container 56 in their normal non-compressed state which requires much more room and space for shipping and/or transport and/or storage of the sponges with microfiber 10.

The detailed description of exemplary embodiments of the invention herein shows various exemplary embodiments and the best modes, known to the inventor at this time, of the invention. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those reasonably skilled in the art. Additionally, all included figures are non-limiting illustrations of the exemplary embodiments and modes, which similarly avail themselves to any equivalent modes or embodiments that are known or obvious to those reasonably skilled in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

Unless specifically noted, it is the Applicant's intent that the words and phrases in the specification and the claims be given the commonly accepted generic meaning or an ordinary and accustomed meaning used by those of ordinary skill in the applicable arts. In the instance where these meanings differ, the words and phrases in the specification and the claims should be given the broadest possible, generic meaning. If any other special meaning is intended for any word or phrase, the specification will clearly state and define the special meaning.

The invention claimed is:

1. A sponge with microfiber comprising:

a foam sponge having a front side, a back side, and a plurality of edges between the front and back sides; and a microfiber material laminated to one side of the foam sponge wherein the microfiber material is inset from all edges of the foam sponge on the side of the foam sponge to which it is laminated and wherein an exposed surface of the laminated microfiber material is not positioned below a surface of the side of the sponge to which it is laminated.

2. The sponge of claim 1 further comprising a permeable film positioned between the foam sponge and the microfiber material which functions to connect the foam sponge to the microfiber material.

3. The sponge of claim 2 wherein the permeable film is comprised of a polyurethane.

4. The sponge of claim 1 wherein at least one of the plurality of edges comprises a beveled edge.

5. The sponge of claim 4 wherein each of the plurality of edges comprises a beveled edge.

6. The sponge of claim 1 wherein at least one of the plurality of edges comprises a chamfered edge.

7. The sponge of claim 6 wherein each of the plurality of edges comprises a chamfered edge.

8. A sponge with microfiber comprising:

a foam sponge having a front side, a back side, and a plurality of edges between the front and back sides wherein at least one of the plurality of edges comprises a contoured edge; and a microfiber material laminated to at least one side of the foam sponge wherein the microfiber material is inset from all edges of the foam sponge on the side of the foam sponge to which it is laminated and wherein an exposed surface of the laminated microfiber material is not positioned below a surface of the side of the sponge to which it is laminated.

9. The sponge of claim 8 wherein the contoured edge comprises at least one of a beveled edge or a chamfered edge.

* * * * *